US010784627B1

(12) United States Patent
Baxter

(10) Patent No.: US 10,784,627 B1
(45) Date of Patent: Sep. 22, 2020

(54) METAL SELF-LOCKING EXTENSION CORD

(71) Applicant: Jeremy Baxter, New Boston, TX (US)

(72) Inventor: Jeremy Baxter, New Boston, TX (US)

( * ) Notice: Subject to any disclaimer, the term of this patent is extended or adjusted under 35 U.S.C. 154(b) by 0 days.

(21) Appl. No.: 16/394,831

(22) Filed: Apr. 25, 2019

(51) Int. Cl.
*H01R 4/26* (2006.01)
*H01R 13/639* (2006.01)
*H01R 13/52* (2006.01)

(52) U.S. Cl.
CPC ..... *H01R 13/6392* (2013.01); *H01R 13/5219* (2013.01)

(58) Field of Classification Search
CPC ..... H01R 13/6392; H01R 13/5219
USPC ..... 439/271, 369, 364, 348, 352
See application file for complete search history.

(56) References Cited

U.S. PATENT DOCUMENTS 4,595,251 A * 6/1986 Moulin ..... G02B 6/3816 439/289
4,605,273 A * 8/1986 Horton ..... H01R 31/06 439/341
4,875,874 A * 10/1989 Windsor, Jr. ..... H01R 13/6392 439/369
5,259,782 A * 11/1993 Giffin ..... H01R 13/6392 439/314
5,480,313 A * 1/1996 d'Alayer de Costemore d'Arc ..... H01R 13/635 439/159
5,551,884 A * 9/1996 Burkhart, Sr. ..... H01R 13/20 439/140
5,984,687 A * 11/1999 Schwarz ..... H01R 39/643 439/17
6,022,237 A * 2/2000 Esh ..... H01R 13/5219 439/348
6,454,576 B1 * 9/2002 Hedrick ..... H01R 13/5812 439/105
6,602,087 B1 * 8/2003 Carle ..... H01R 13/53 439/367
6,945,805 B1 * 9/2005 Bollinger ..... H01R 13/6276 439/348
7,189,100 B1 * 3/2007 Colbourne ..... H01R 13/6392 439/367
7,442,067 B1 * 10/2008 Amaral ..... H01R 13/639 439/367
7,497,705 B2 * 3/2009 Larson ..... H01R 13/6397 439/133

(Continued)

*Primary Examiner* — Abdullah A Riyami
*Assistant Examiner* — Nelson R. Burgos-Guntin
(74) *Attorney, Agent, or Firm* — Dale J. Ream

(57) ABSTRACT

A self-locking extension cord for extending electrical power to an associated auxiliary electrical cord includes a power cord having opposed first and second ends, the cord constructed of an elongate adjustable metal material containing a plurality of conductive wires. The extension cord includes male and female electrical receptacles fixedly attached to first and second ends of the cord member. The extension cord includes a male plug receiving member selectively and releasably coupled to the first end of the cord member, the male plug receiving member including first and second pivotally connected receiving portions movable between a closed configuration in which the first and second receiving portions receive one of the male electrical receptacle or the auxiliary male electrical receptacle associated with the auxiliary extension cord. A female plug receiving member is coupled to female electrical receptacle, the male and female receiving members having locking structures for being locked together.

14 Claims, 20 Drawing Sheets

(56) References Cited

U.S. PATENT DOCUMENTS

| | | | | |
|---|---|---|---|---|
| 8,262,403 | B2 * | 9/2012 | Slippy | H01R 13/5808 439/353 |
| 8,382,507 | B2 * | 2/2013 | Yamaguchi | H01R 13/6275 439/346 |
| 9,413,101 | B1 * | 8/2016 | Nooner | H01R 13/5208 |
| 9,518,690 | B2 * | 12/2016 | Belisle | A62C 33/04 |
| 9,831,624 | B2 * | 11/2017 | Garvey | H01R 31/06 |
| 10,118,573 | B2 | 11/2018 | Nakai | |
| 10,211,547 | B2 * | 2/2019 | Burris | H01R 43/16 |
| 2002/0115353 | A1 * | 8/2002 | Zeiler | H01R 13/625 439/660 |
| 2011/0083898 | A1 | 4/2011 | Miller, III | |

* cited by examiner

METAL SELF-LOCKING EXTENSION CORD

BACKGROUND OF THE INVENTION

This invention relates generally to extension cords and, more particularly, to a self-locking extension cord having an adjustable, metal, and impermeable construction for extending electrical power to an associated electrical power cord or tool having an electrical cord.

Extension cords have been used almost since the beginning of delivering electrical current through wires. Such cords allow the delivery of electricity over long distances and are critical to industries such as construction jobs, connection of tools outside a business or residence, and oftentimes in very rugged environments. A major problem with connecting multiple extension cords together, of course, is that if any single connection of male-female receptacles are pulled apart, electrical power is interrupted until the location of separation is located and plugged back in. Another problem with traditional extension cords is that rugged environments may result in damage, holes, or rips in the cord that may expose the electrical wires inside and cause danger of electrocution, fire, or inconsistent operation.

Various devices have been proposed in the prior art for interlocking male-female receptacles together in an effort to make extension cords more reliable. Although presumably effective for their intended purposes, there is still a need for a more comprehensive self-locking extension cord implementing a metal, durable, and yet partially flexible electrical cable that also includes a male plug receiving housing for joining multiple extension cords or tool power cables together.

Therefore, it would be desirable to have a self-locking extension cord that satisfies the objectives of the present invention and improves the disadvantages of traditional extension cords.

SUMMARY OF THE INVENTION

A self-locking extension cord according to the present invention for use with an auxiliary male electrical plug associated with an auxiliary electrical cord includes a cord member having opposed first and second ends, the cord member having an elongate configuration and is constructed of an adjustable metal material that defines an interior channel containing a plurality of conductive wires. The extension cord includes a male electrical receptacle fixedly attached to the first end of the cord member and is electrically connected to the plurality of wires in the interior channel of the cord member. The extension cord also includes a male plug receiving member selectively and releasably coupled to the first end of the cord member, the male plug receiving member, including a first receiving portion and a second receiving portion pivotally coupled to the first receiving portion and movable between a closed configuration in which the first and second receiving portions, together, define an interior area and an open configuration operable to receive into the interior area one of the male electrical receptacle or the auxiliary male electrical receptacle associated with the auxiliary extension cord.

A female electrical receptacle is coupled to a second end of the cord member and electrically connected to the plurality of electrical wires of the cord member. Further, a female plug receiving member is fixedly coupled to and envelops the female electrical receptacle, the female plug receiving member including a flexible wall having a domed configuration and a female locking structure that defines a pair of receiver plug recesses, the flexible wall being constructed of a resilient material that is movable between a collapsed configuration allowing access to the pair of receiver plug recesses and a closed configuration not allowing access to the pair of receiver plug recesses.

Then, the first receiver portion and the second receiver portion of the male plug receiving member include a receiver portion locking structure having a pair of locking tabs extending away from front edges of the first receiver portion and the second receiver portion, respectively. The pair of receiver plug recesses is configured and operable to selectively receive the pair of locking tabs of the receiver portion locking structure, respectively.

Therefore, a general object of this invention is to provide a self-locking extension cord that extends electrical power to an associated power cord while securely holding electrical plugs from separating from one another.

Another object of this invention is to provide a self-locking extension cord, as aforesaid, that includes a male plug receiving member that opens to receive a male plug from an associated cord member and to hold the received plug in a locked engagement to the self-locking extension cord.

Still another object of this invention is to provide a self-locking extension cord, as aforesaid, that has an adjustable metal cord that is more durable and water resistant than a traditional extension cord.

Yet another object of this invention is to provide a self-locking extension cord, as aforesaid, that is cost effective to produce and to purchase.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
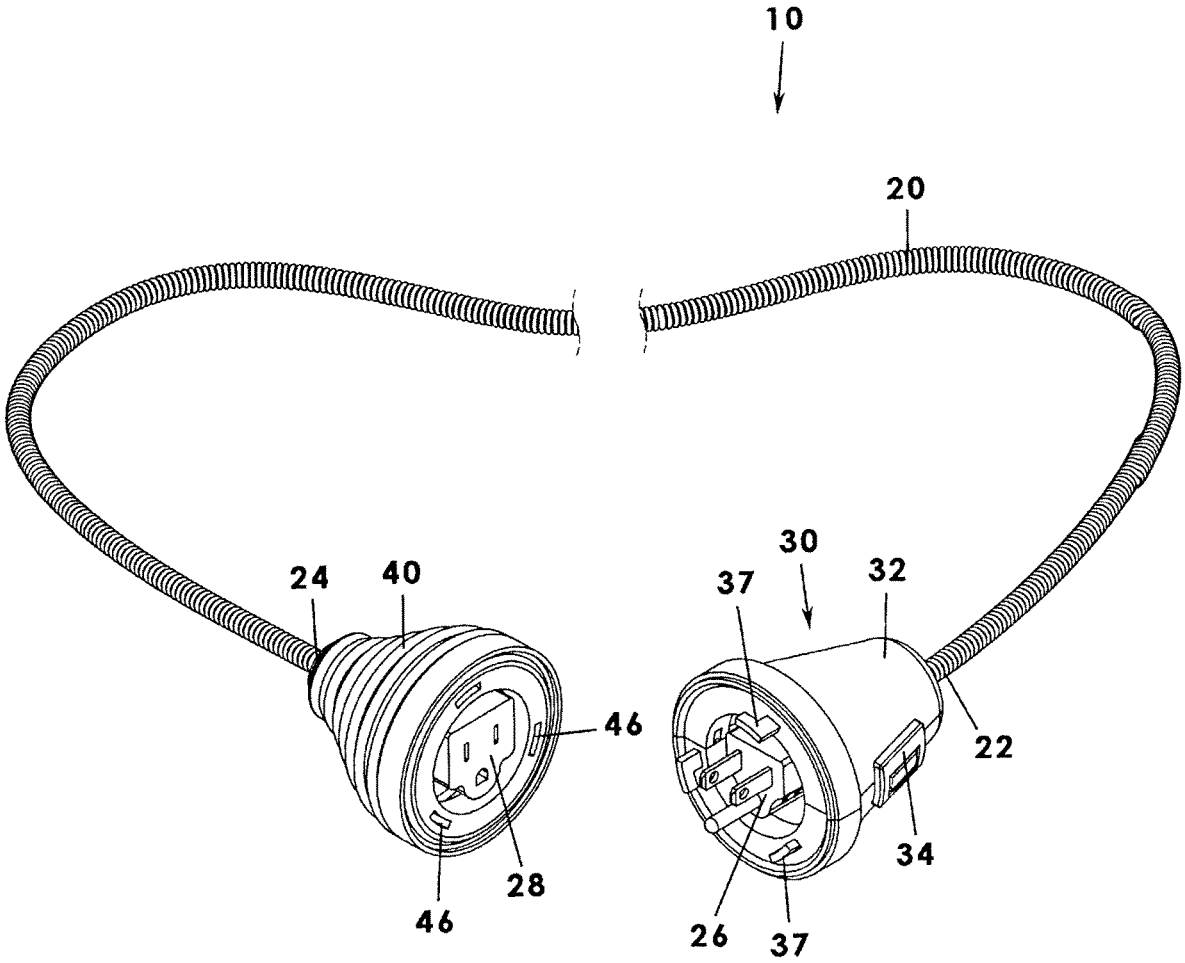
FIG. 1 is a perspective view of a self-locking extension cord according to a preferred embodiment of the present invention.

A self-locking extension cord according to a preferred embodiment of the present invention will be described in detail with reference to FIGS. 1 to 23 of the accompanying drawings. The self-locking extension cord 10 includes a cord member 20, a male electrical receptacle 26, a female electrical receptacle 26, and a male plug receiving member 30 removable from the extension cord member 20.

The self-locking extension cord 10 has the general appearance of a traditional extension cord for extending the distance for delivery of electrical power to a remote electrical cord, appliance, tool, or the like. However, the self-locking extension cord 10 includes structures for preventing electrical plugs from becoming separated in use which, obviously, causes power delivery to be broken. The self-locking extension cord 10 also provides an adjustable metal cord construction that is durable and virtually impermeable to exposure of internal wires to water intrusion.

More particularly, the cord member 20 has an elongate construction having an outer layer that may be constructed of a partly flexible metal or metal-banded material. For instance, the cord member 20 is durable in harsh construction environments and still has flexibility to be shaped by a user as needed to move around corners or other objects. The extension cord member 20 may include a continuous side wall so as to define an interior channel for containing a plurality of conductive electrical wires.

The cord member 20 includes a first end 22 and a second end 24 opposite the first end 22. Male and female electrical receptacles are coupled to the opposed ends, respectively. Specifically, a traditional male electrical receptacle 26 may be fixedly and electrically connected to the first end 22 of the cord member 20. The male electrical receptacle 26 include 2 or 3 outwardly extending prongs intended for connection to an electrical wall socket or to a female electrical receptacle, such as for delivery electrical current to a remote extension cord, tool, or the like. Further, a generally traditional female electrical receptacle 28 is fixedly and electrically connected to the second end 24 of the cord member 20 with electrical current being carried via the plurality of electrical wires.

Figure 12:
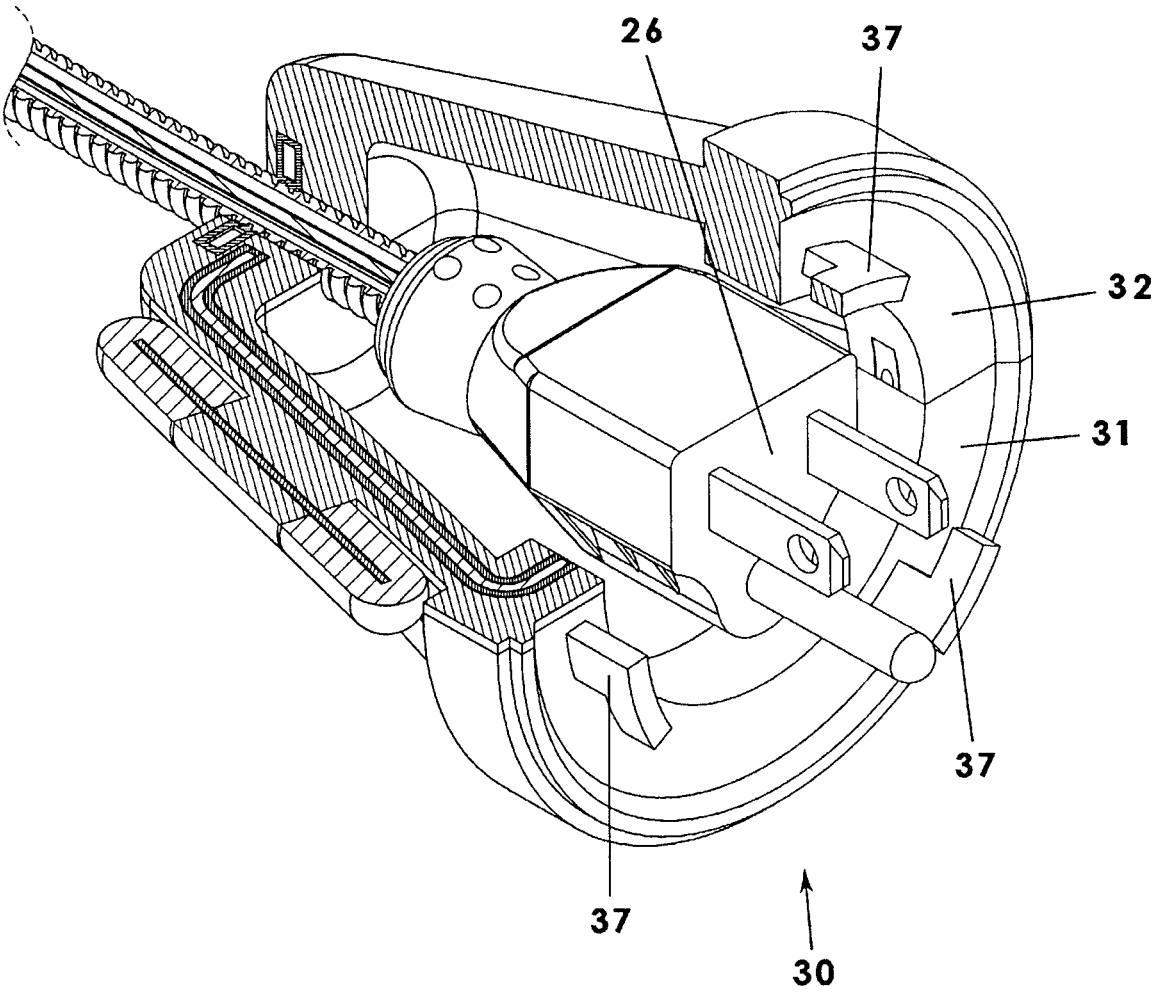
FIG. 12 is a fragmentary view of another end view of the self-locking extension cord as in FIG. 1.
Figure 13:
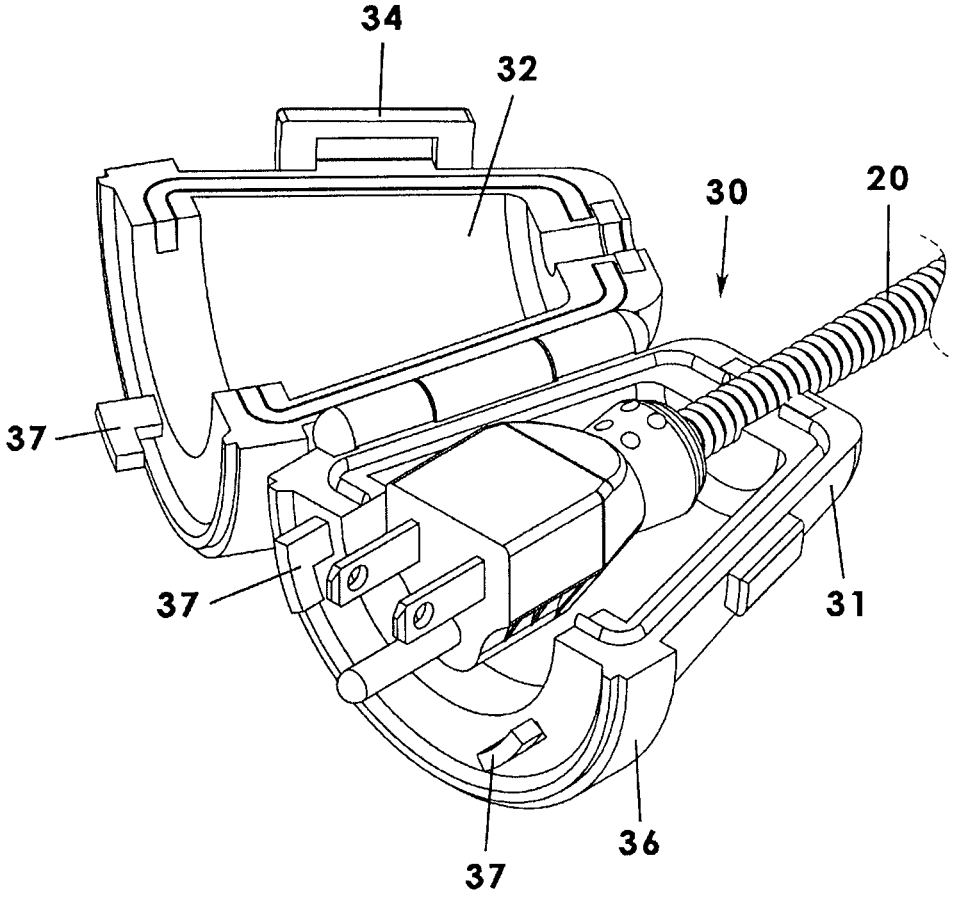
FIG. 13 is an isolated view on an enlarged scale taken from FIG. 1, illustrated with the male plug receiving member in an open configuration.
Figure 14:
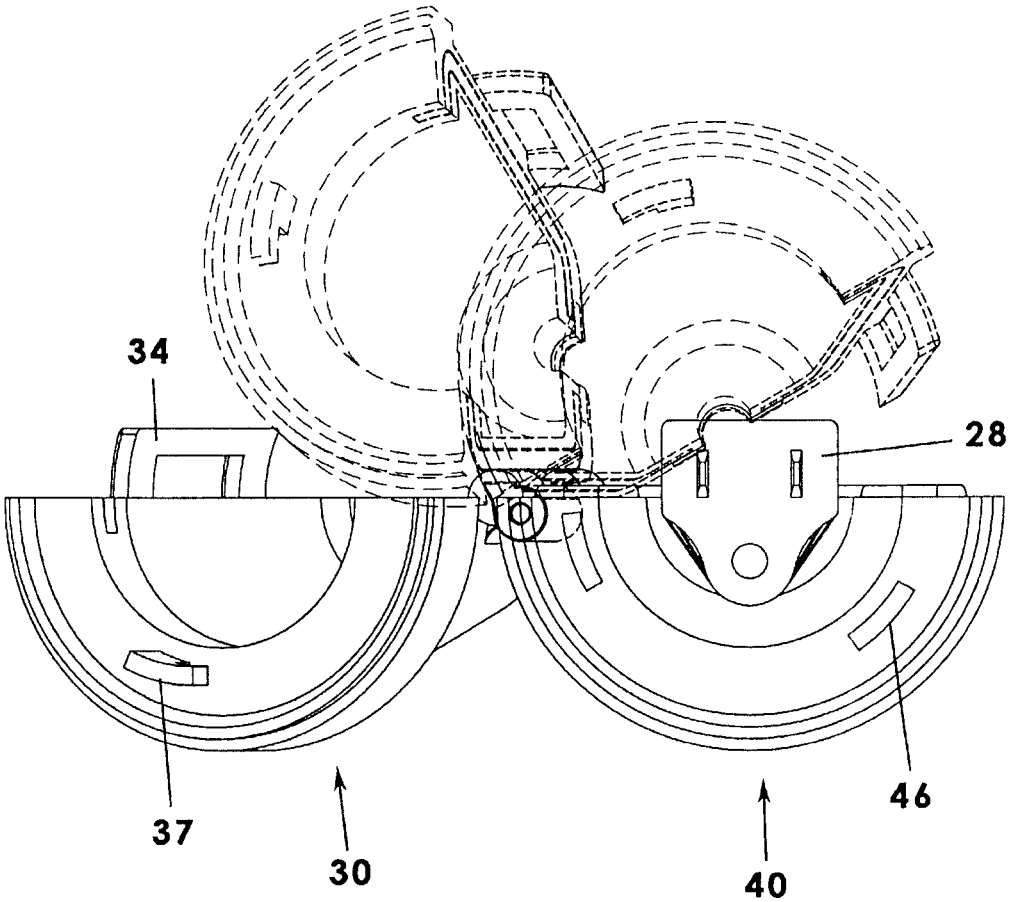
FIG. 14 is a plan view illustrating operation of the male plug receiving member according to the present invention.
Figure 15:
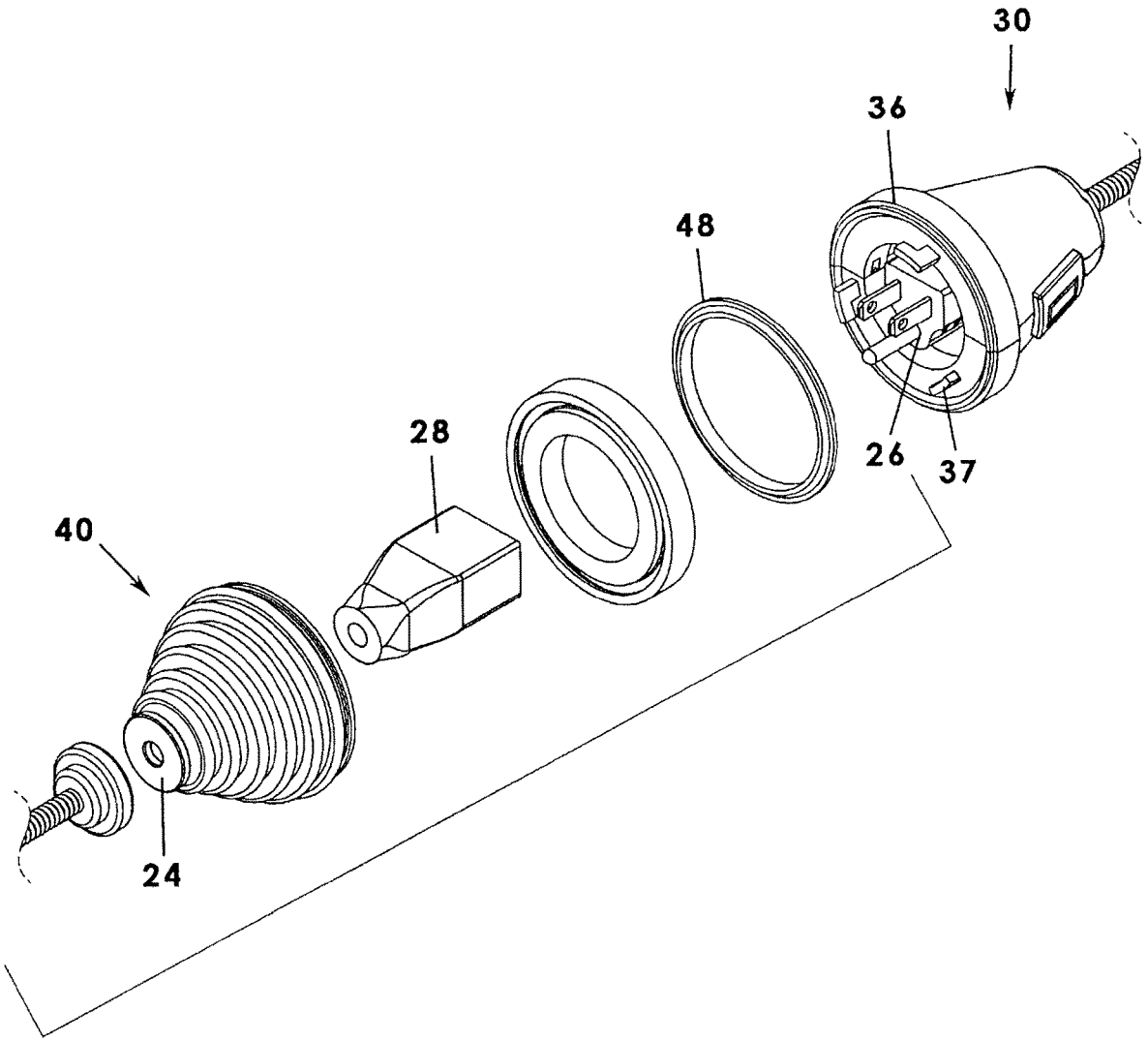
FIG. 15 is an exploded view of the female receptacle side of the self-locking extension cord as in FIG. 1.
Figure 16:
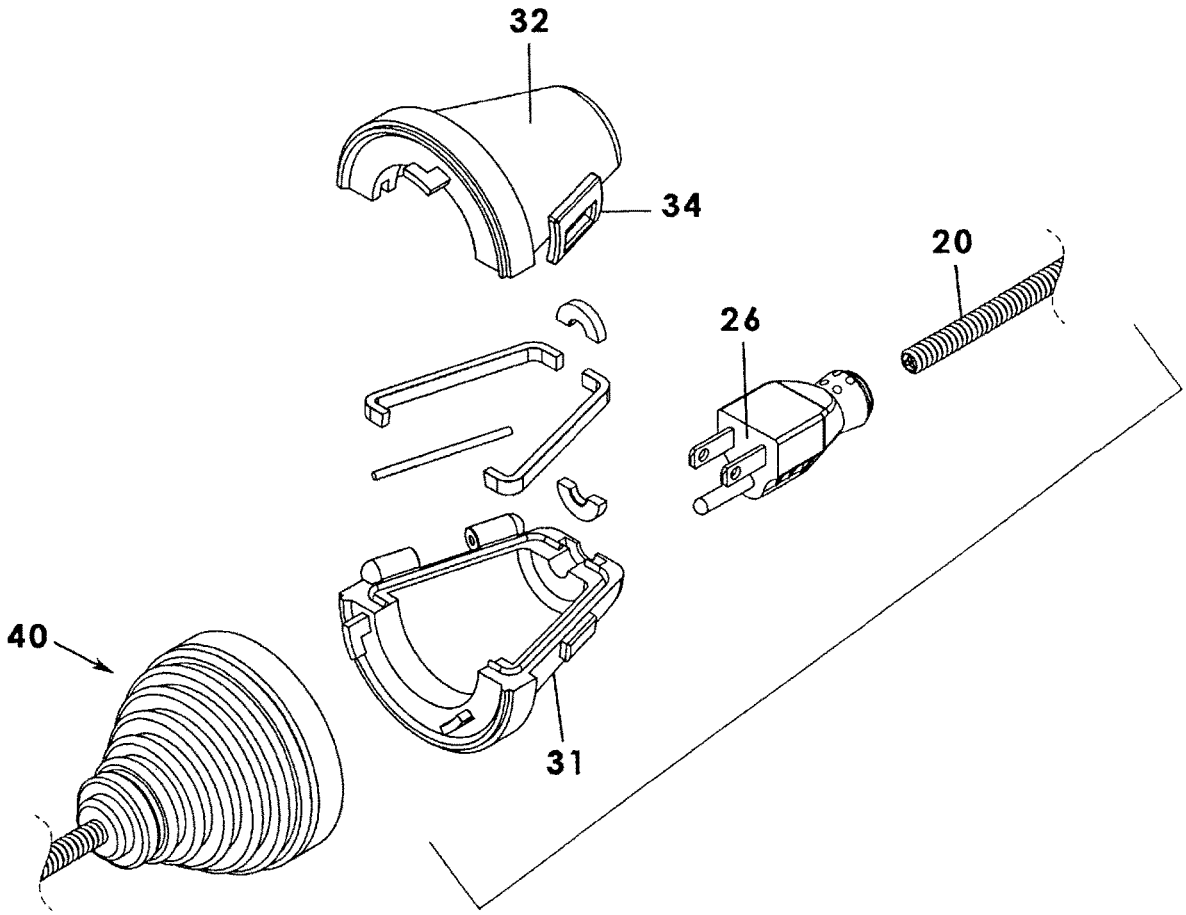
FIG. 16 is an exploded view of the male receptacle side of the self-locking extension cord as in FIG. 1.
Figure 17:
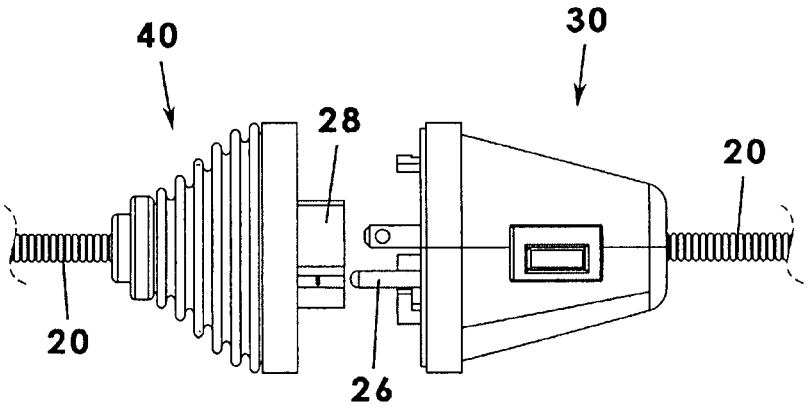
FIG. 17 is a side view illustrating the female plug receiving member separated from the male plug receiving member as in FIG. 1.
Figure 18:
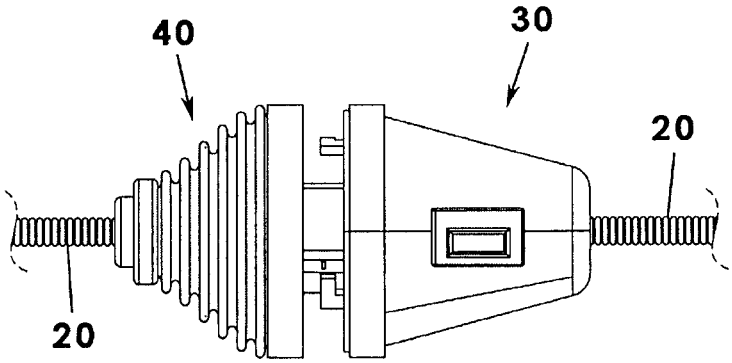
FIG. 18 is a side view illustrating the female plug receiving member partially coupled to the male plug receiving member.
Figure 19:
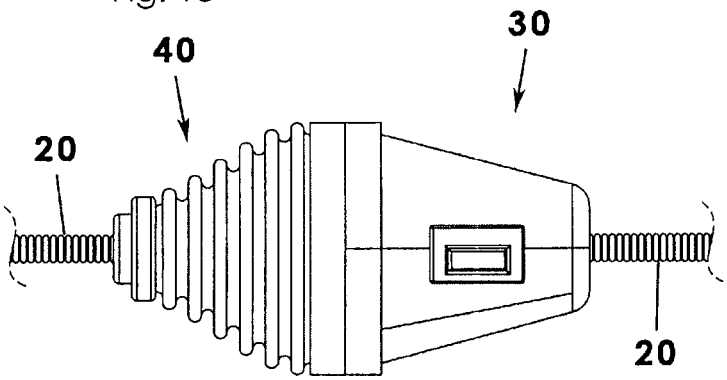
FIG. 19 is a side view illustrating the female plug receiving member completely coupled to the male plug receiving member.
Figure 20:
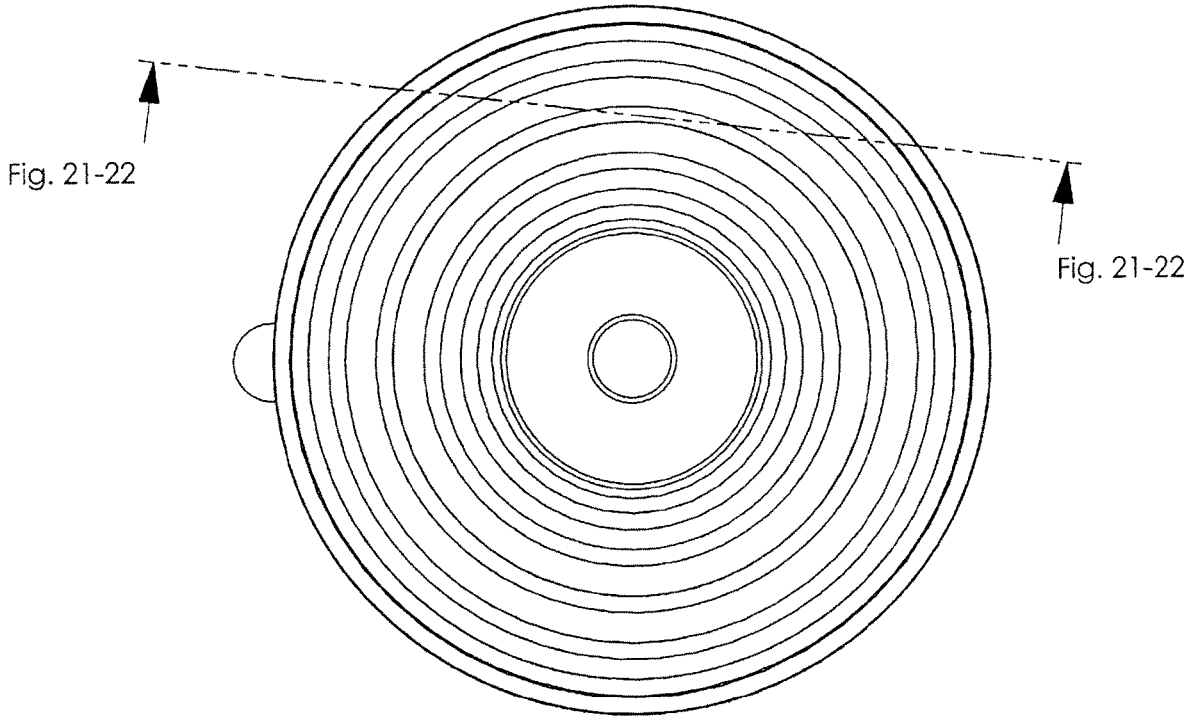
FIG. 20 is another end view of the present invention.
Figure 21:
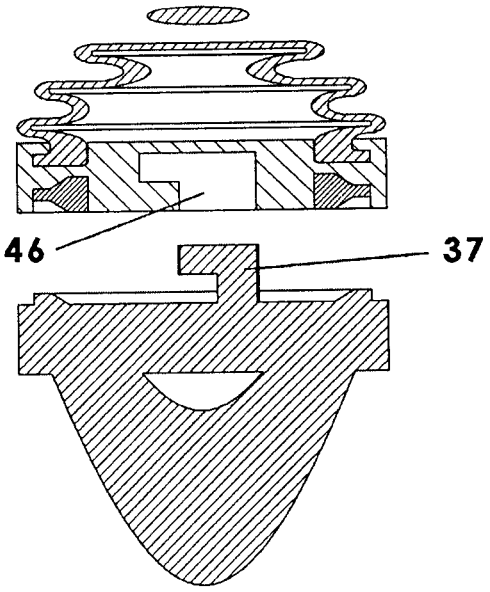
FIG. 21 is a sectional view taken along line 21-21 of FIG. 20.
Figure 22:
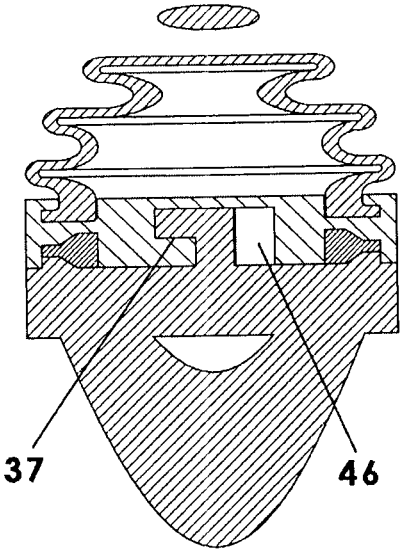
FIG. 22 is a sectional view taken along line 22-22 of FIG. 20.
Figure 23:
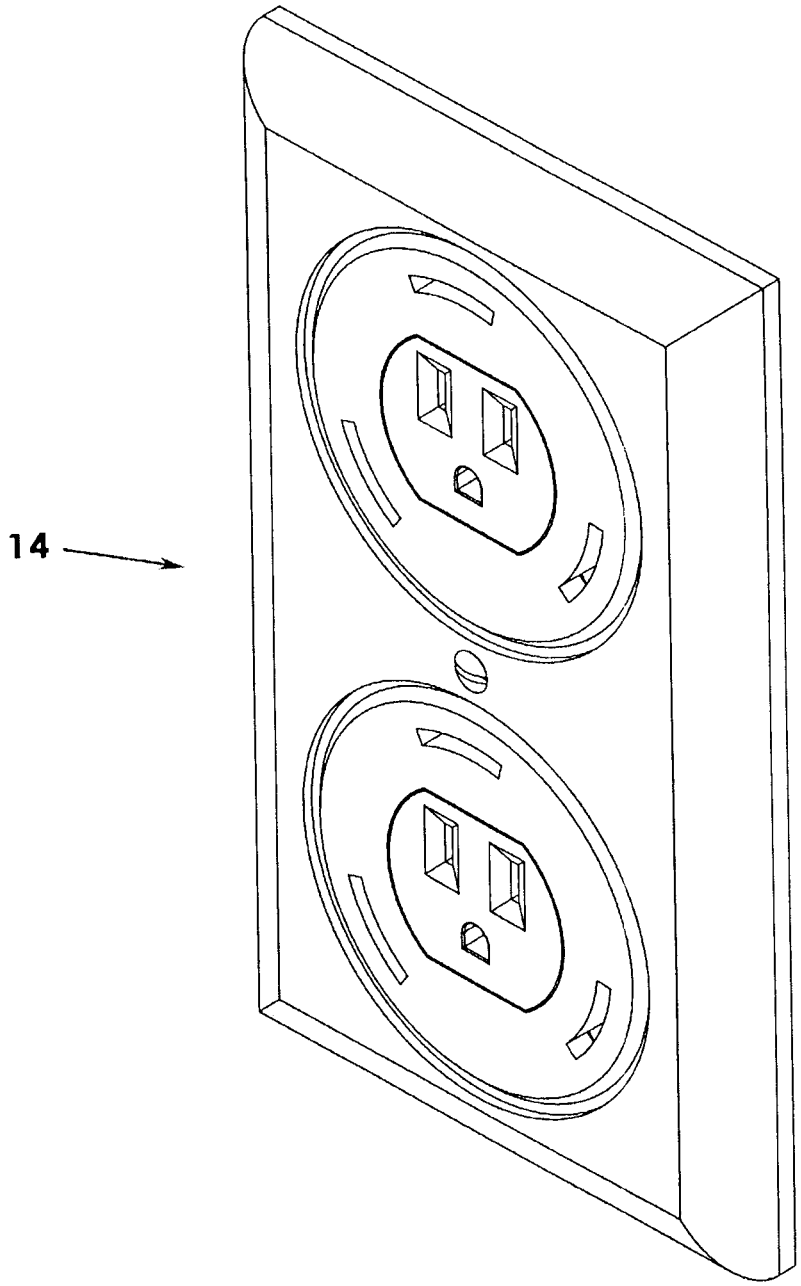
FIG. 23 is a perspective view of an electrical socket having locking structures for use with the present invention.

Next, the self-locking extension cord 10 includes a male plug receiving member 30 and a female plug receiving member 40—the two structures having both similarities to one another as well as significant inventive differences as will be described later. The male plug receiving member 30 may be selectively and removably coupled to the first end 22 of the cord member 20 and includes a first receiving portion 31 pivotally and selectively coupled to a second receiving portion 32. The male plug receiving member 30, therefore, may be secured about the male electrical receptacle 26 of the self-locking extension cord 10 (FIG. 1) or about an auxiliary male plug of an associated extension cord, tool 12, or the like. More particularly, the first receiving portion 31 may have a generally hemispherical configuration and defines an interior area operable to receive a portion of a male electrical plug. The male plug receiving member 30 may also include a second receiving portion 32 having a generally hemispherical configuration and that defines an interior area operable to receive another portion of a male electrical plug. The male plug receiving member 30 is pivotally movable, such as via a hinge 33, between an open configuration operable to receive the male electrical plug therein (or allow its removal) (FIG. 12-14) and a closed configuration that captures the male electrical plug and does not allow its removal therefrom (FIG. 15). The male plug receiving member 30 may also include O-rings 35 or other seals so as to make the housing water-tight and impermeable (FIG. 12). The seal ring 36 of the male plug receiving member 30 is shown in FIG. 15. Further, the male plug receiving member 30 may include a fastener such as a clasp 34 for holding the receiving portions at the closed and temporarily locked and closed configuration (FIGS. 1 and 13).

By contrast, the female plug receiving member 40 is fixedly coupled to the second end second end 24 of the extension cord member 20 and surrounds or envelopes the female electrical receptacle 26. The female plug receiving member 40 may include an outer wall constructed of a flexible material having a generally dome shaped configuration. In other words, the outer wall may include a plurality of ribs 42 or ridges (FIG. 4) that may be flexed and are resilient to return to their normal shape. The female plug receiving member 40 is most narrow at its attachment to the cord member 20 and has an open end (FIG. 1) opposite the narrow end. The flexible construction enables the female plug receiving member 40 to move between a collapsed configuration (essentially "open") giving access to receiver plug recesses 46 and a closed or resilient configuration not allowing access to the recesses 46 as will be described later. In other words, the female plug receiving member 40 can be "peeled back" to enhance usage for locking. The female plug receiving member 40 may also include O-rings or a rubber sealant 44 for sealing out water (FIG. 6), including a female sealing ring 48.

Figure 5:
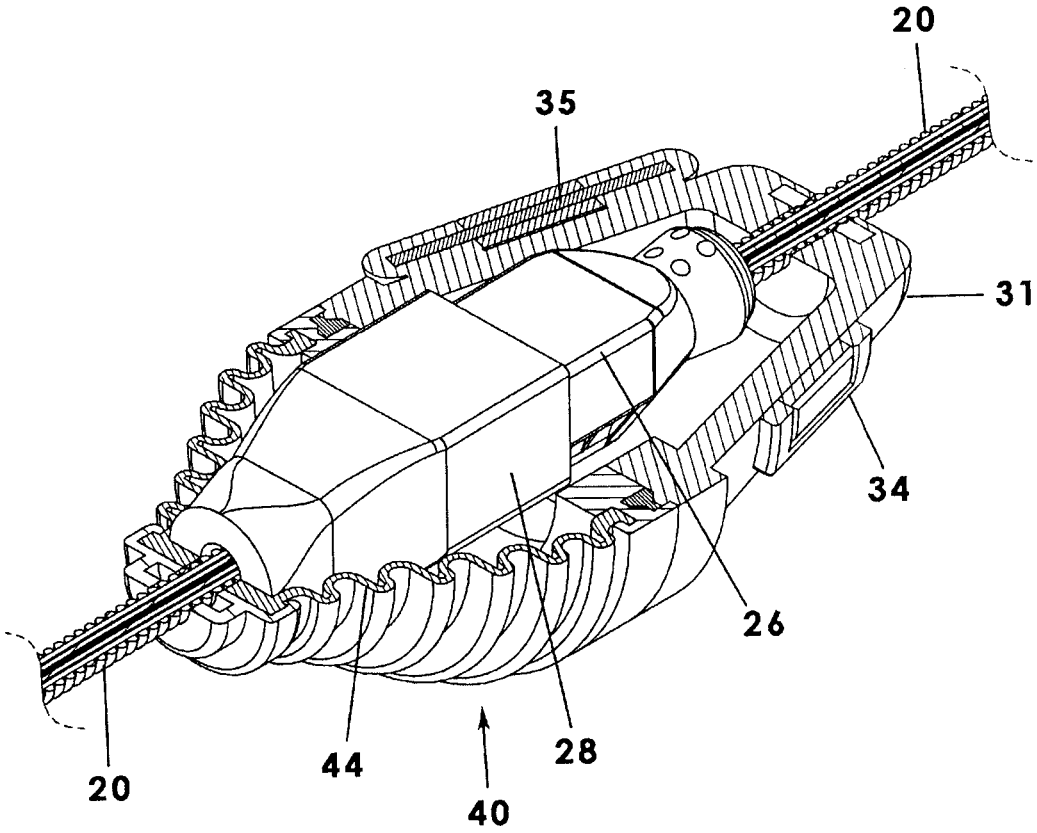
FIG. 5 is a fragmentary view of the illustration of FIG. 3, illustrated with female and male receptacles mated together.
Figure 6:
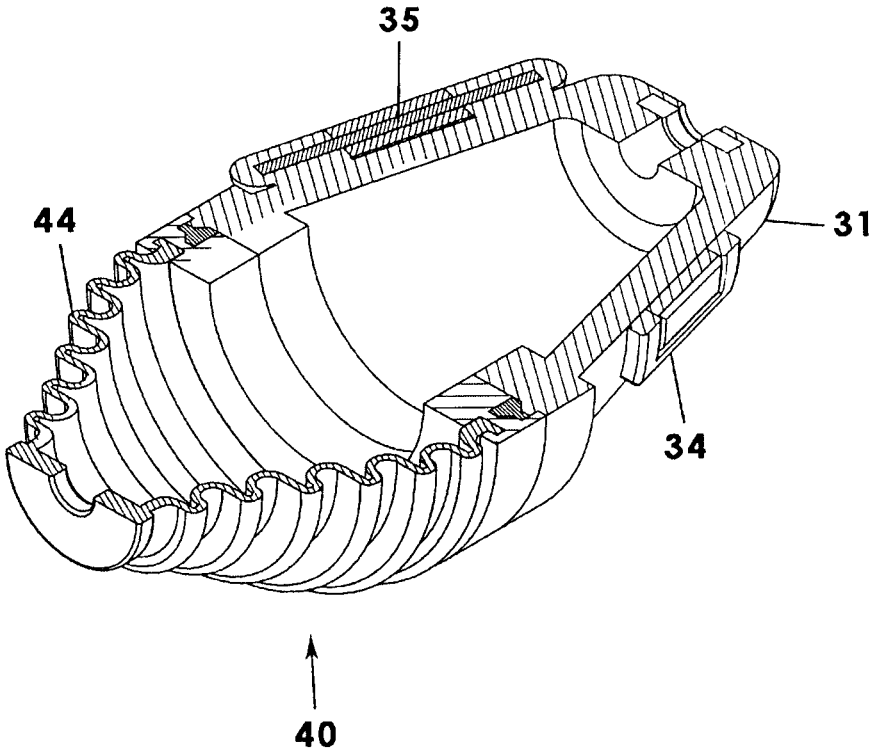
FIG. 6 is a fragmentary view as illustrated in FIG. 5 with the female and male receptacles removed for clarity.
Figure 7:
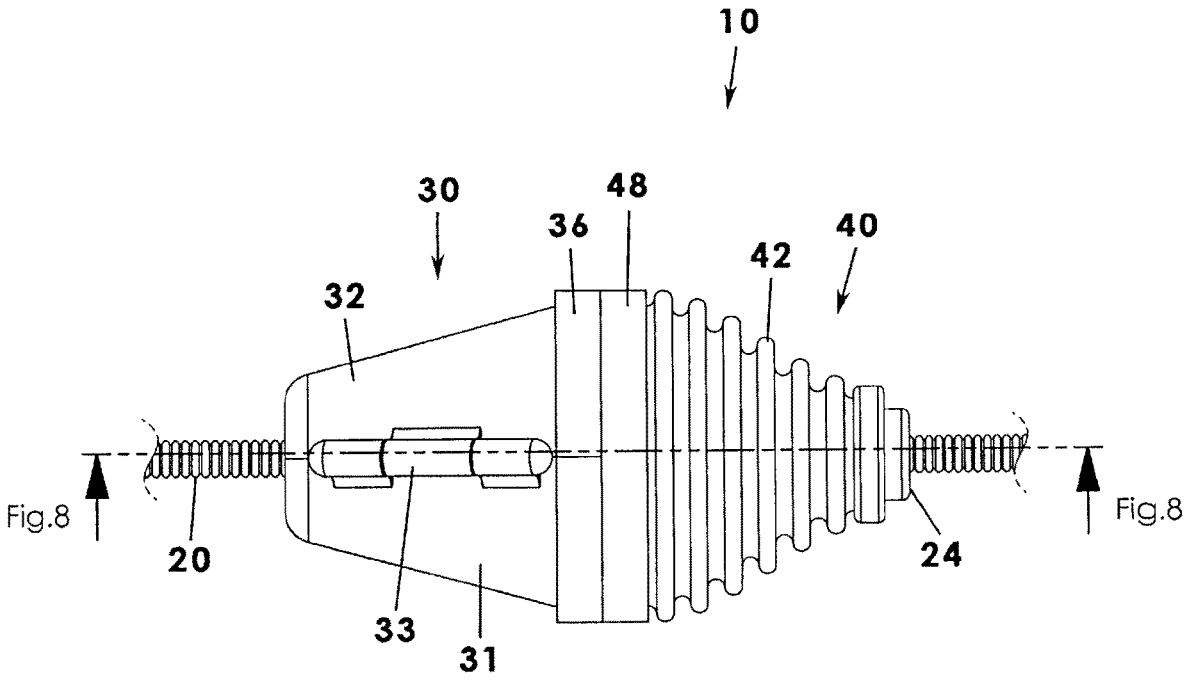
FIG. 7 is another side view of male and female receiving members coupled together.
Figure 8:
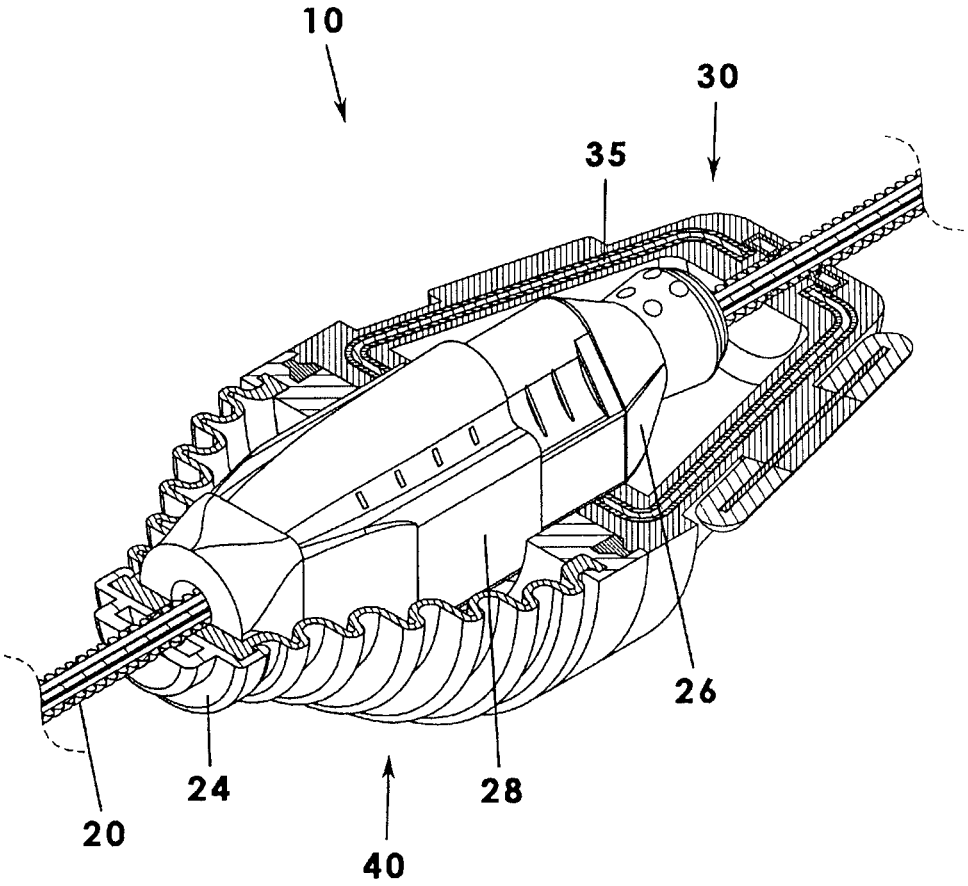
FIG. 8 is a fragmentary view of the illustration as in FIG. 7, illustrated with female and male receptacles mated together.
Figure 9:
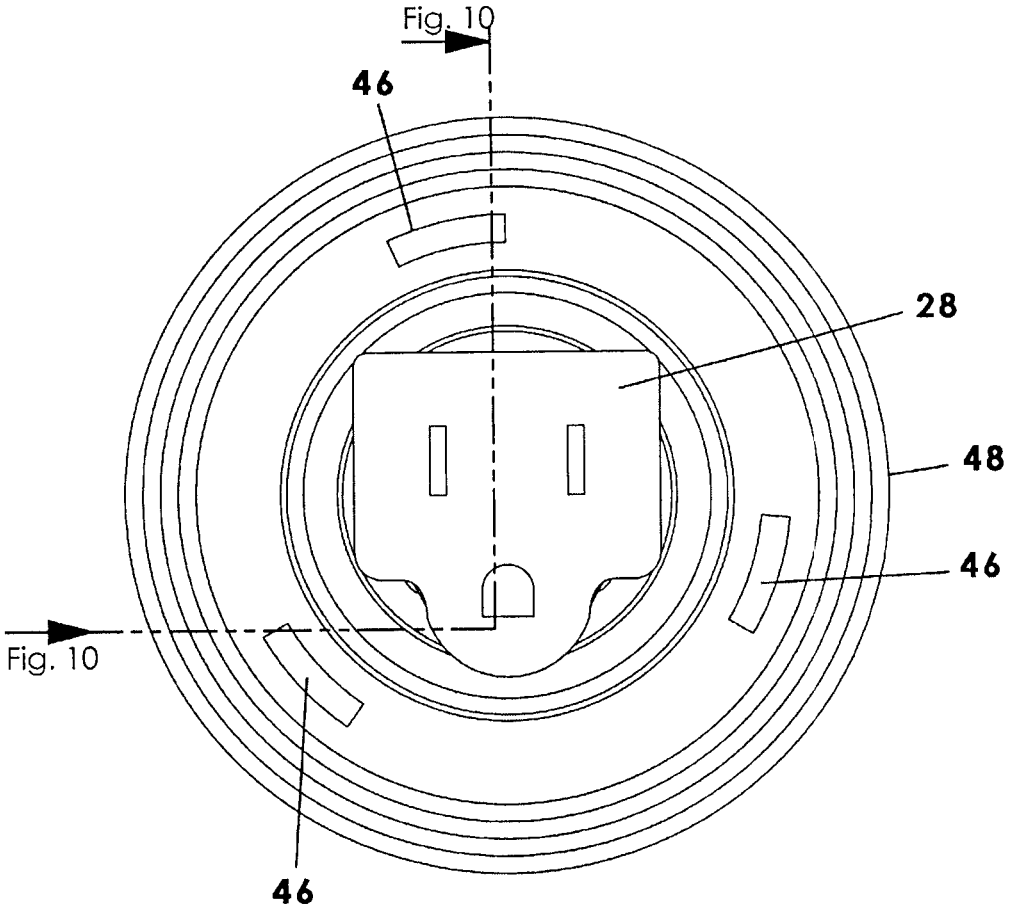
FIG. 9 is an end view of the self-locking extension cord as in FIG. 1, illustrated rotated in a first direction.
Figure 10:
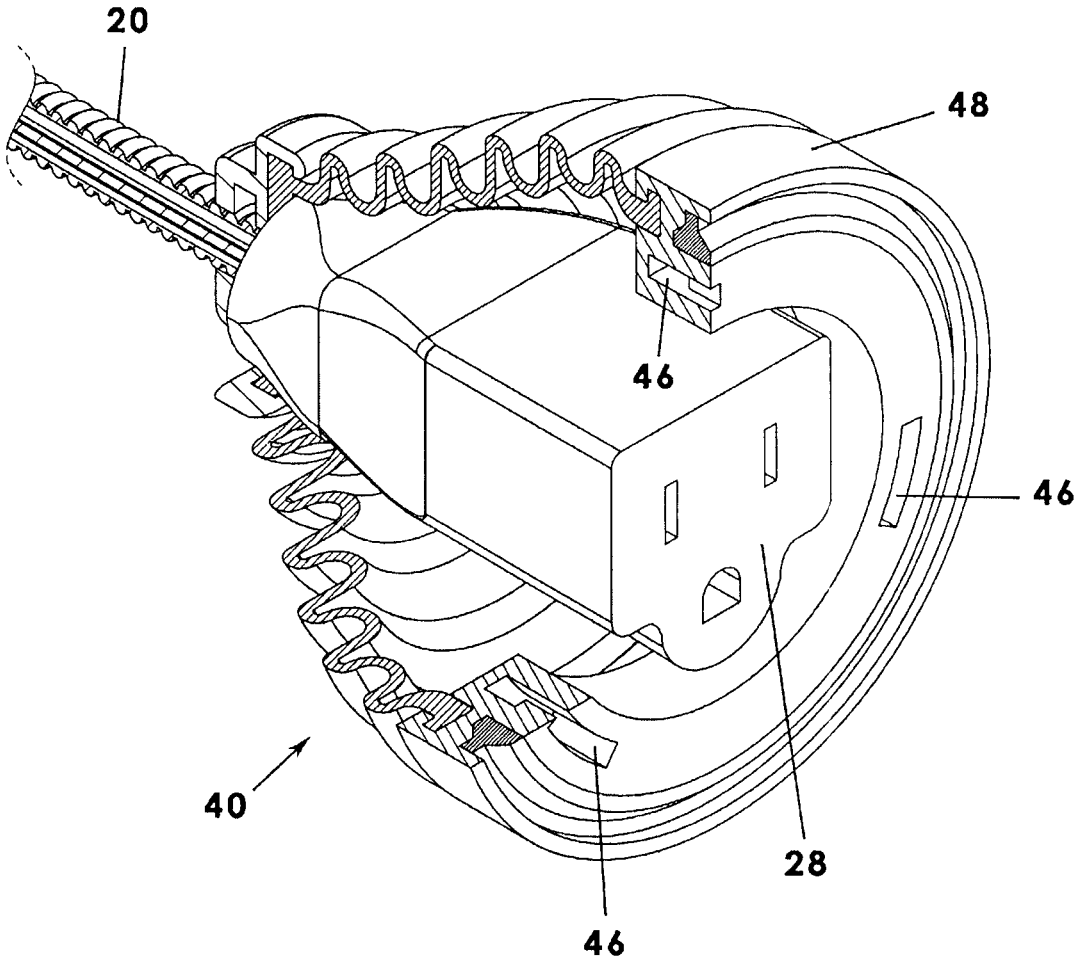
FIG. 10 is a fragmentary view of the self-locking extension cord as in FIG. 10.
Figure 11:
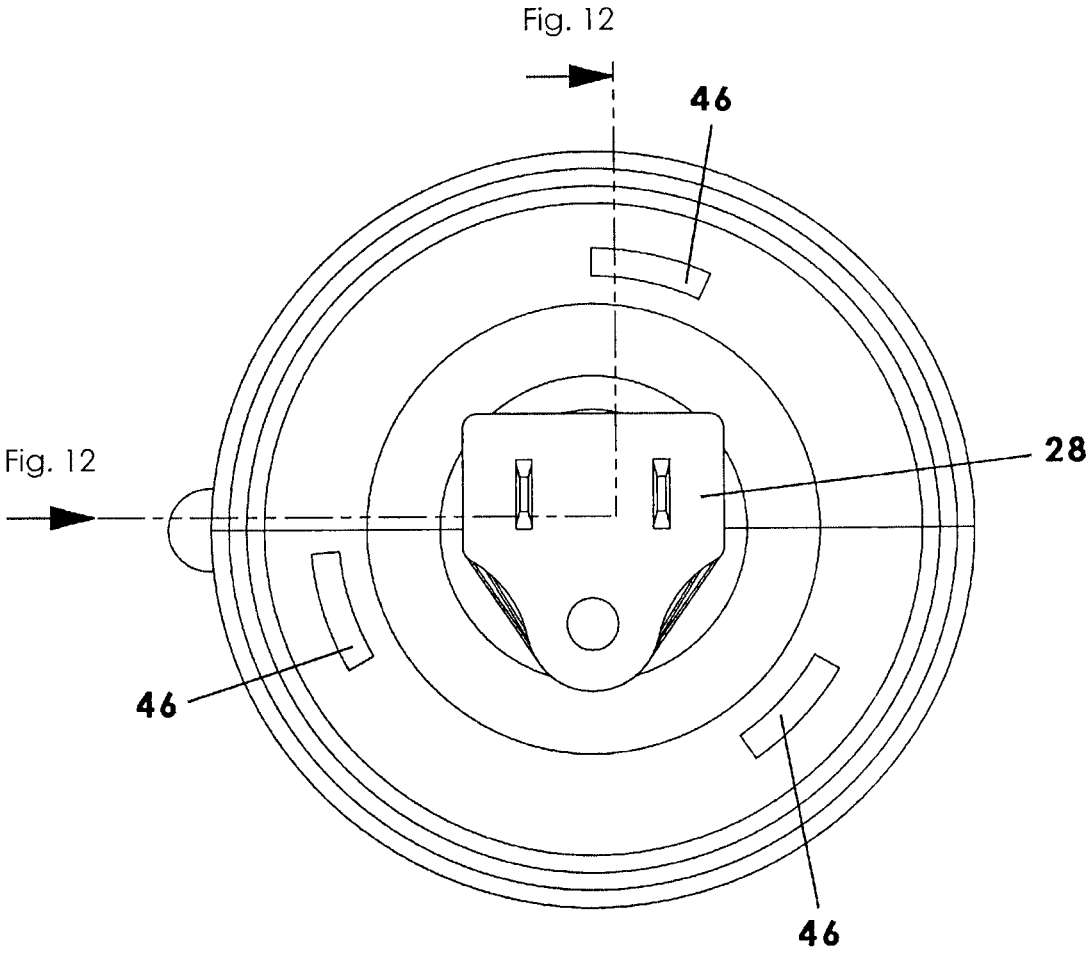
FIG. 11 is an end view of the self-locking extension cord as in FIG. 1, illustrated rotated in a second direction.

Now, both the male plug receiving member 30 and female plug receiving member 40 including locking structures so that the two may be locked together or separated. More particularly, the female plug receiving member 40 includes a front wall having a female locking structure defining at least a pair of receiver plug recesses 46 (FIGS. 1 and 9). Similarly, the male plug receiving member 30 includes a front face having a male locking structure that includes at least a pair of locking tabs 37 or similar flanges that extend outwardly (FIGS. 1 and 12). It is understood that the recesses 46 are dimensioned to selectively receive corresponding locking tabs 37 in a fastened or locking arrangement that is not easily separated in use (FIG. 7), thus, keeping male and female plugs locked together (FIG. 5).

Respective locking tabs 37 are included in respective recesses 46 in a friction fit engagement. Preferably, however, each recess 46 may have a bent configuration beneath its surface, such as an L-shaped interior space. Correspondingly, each locking tab 37 may also have a correspondingly bent or L-shaped configuration operably received by a corresponding slot and then rotated and turned between locked and unlocked configurations.

Figure 2:
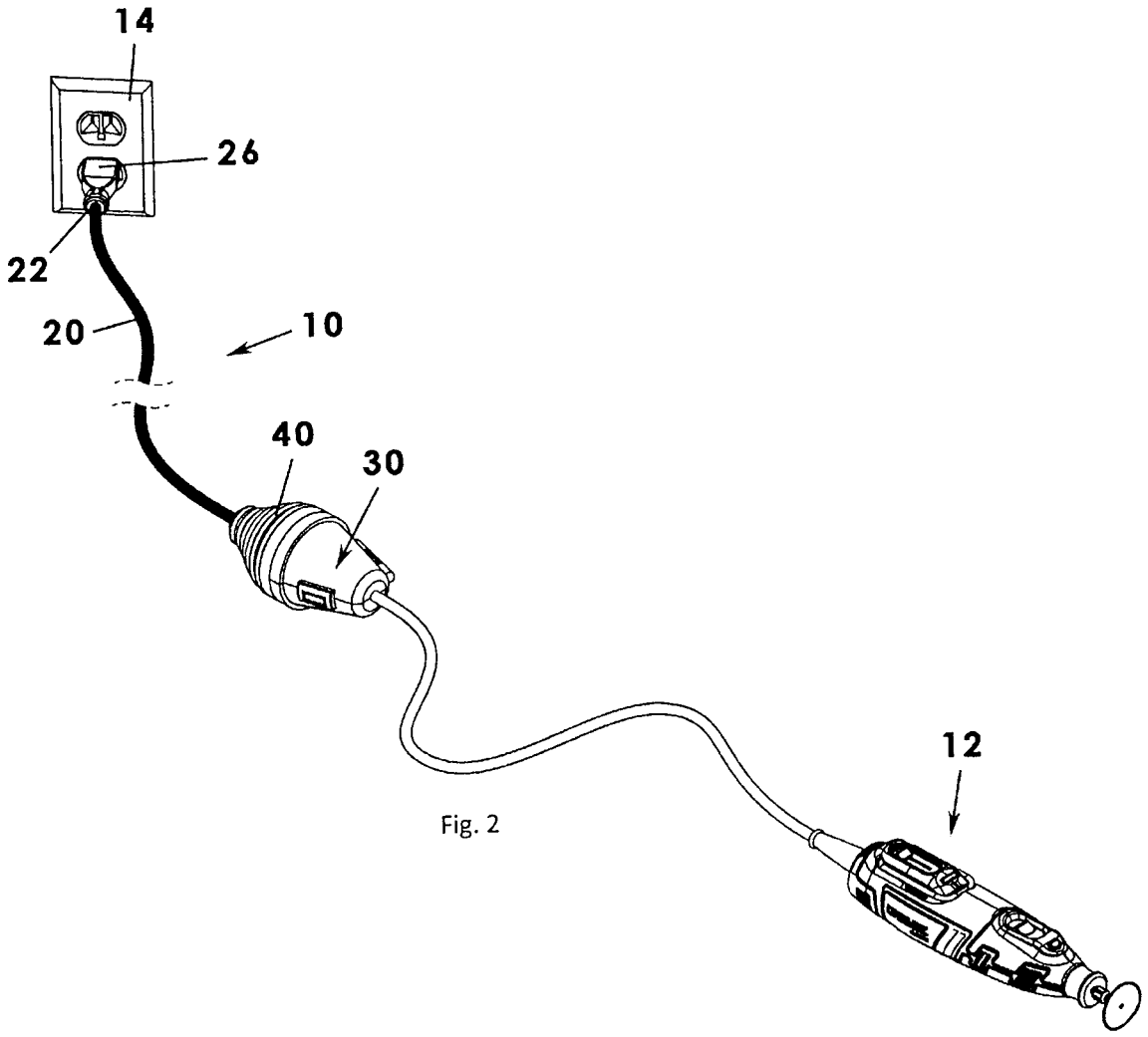
FIG. 2 is another perspective view of the self-locking extension cord as in FIG. 1 in use with an associated tool having an associated power cable.
Figure 3:
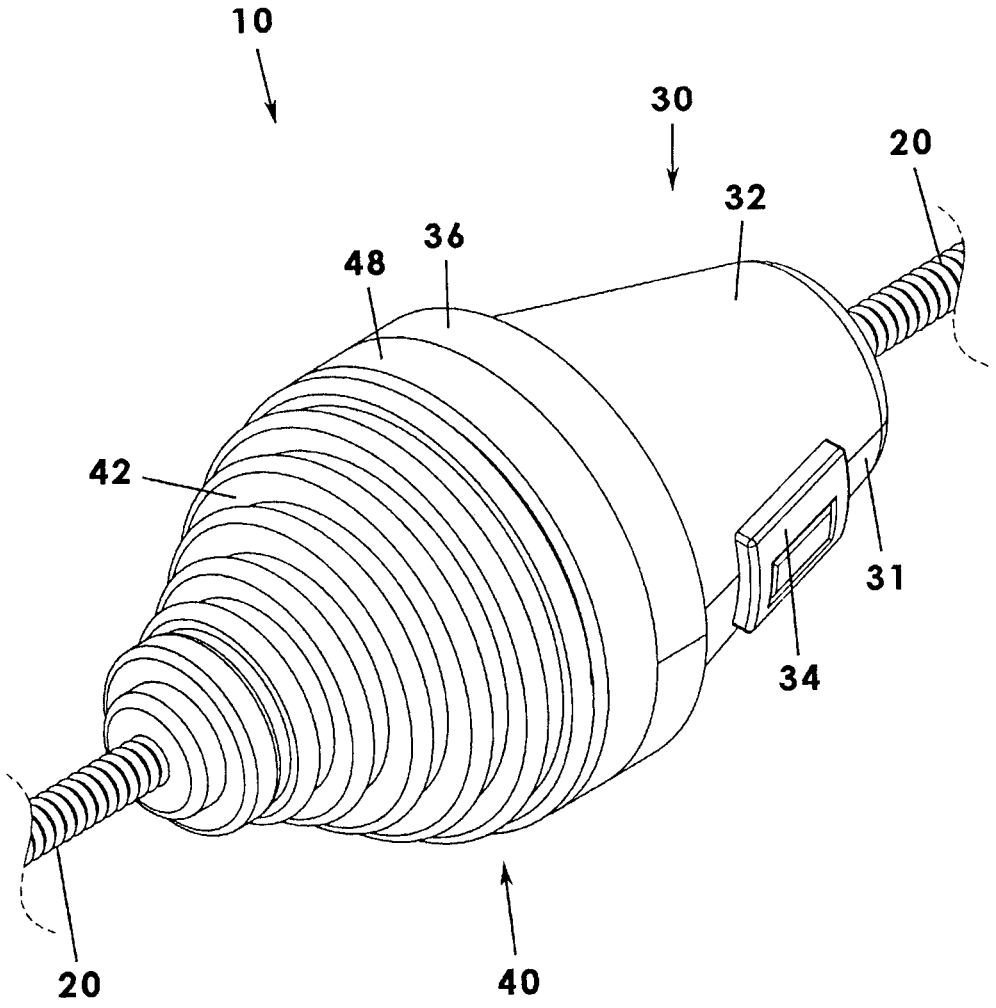
FIG. 3 is an isolated view on an enlarged scale taken from FIG. 1 illustrating the male and female receiving members coupled together.
Figure 4:
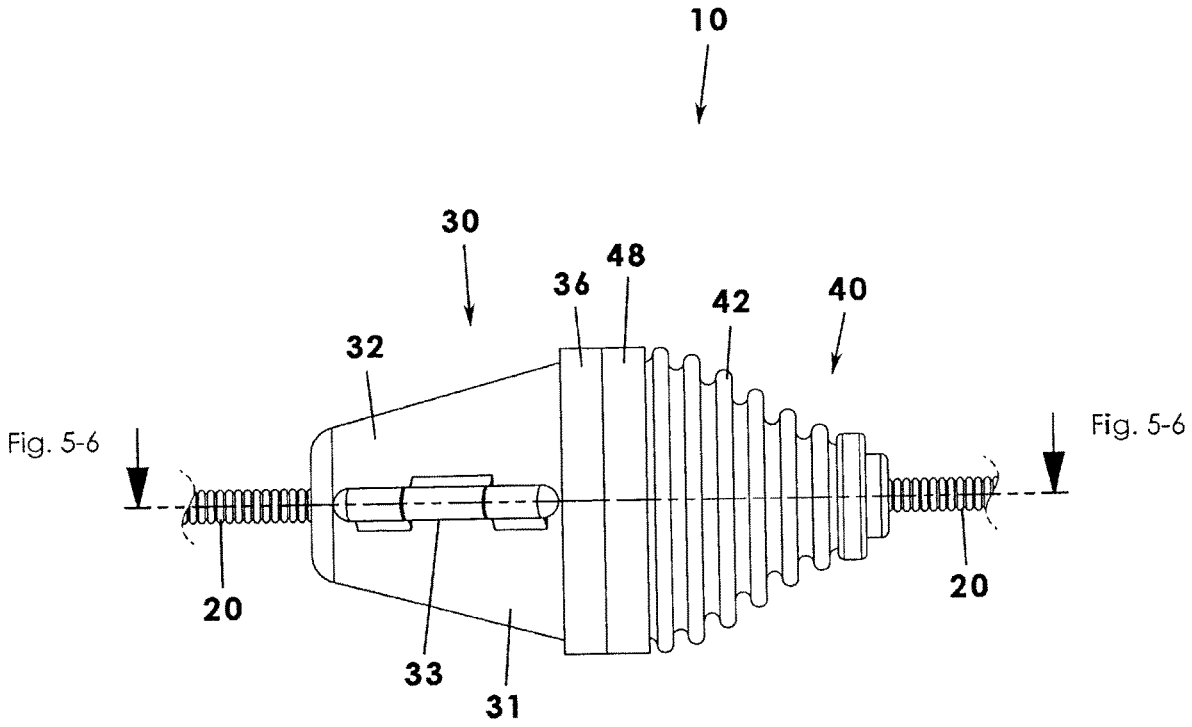
FIG. 4 is a side view of the illustration as in FIG. 3.

In use, the self-locking extension cord 10 has a single structure but is capable of multiple functionalities. First, the metal outer wall of the extension cord member 20 may have a metal construction, is still flexible, but is durable and water-resistant or even water proof. The self-locking extension cord 10 has a male electrical receptacle 26 and a female electrical receptacle 26 that may be plugged into a wall socket 14 for delivering electricity to an associated extension cord or associated tool 12 or the like (FIG. 2). It will be understood that the wall socket may include locking structures substantially similar to those described above that are operable to prevent the self-locking extension cord 10 from becoming dislodged from the socket 14. In addition, the male plug receiving member 30 may be removably coupled to surround either the male electrical receptacle 26 of the self-locking extension cord 10 (FIG. 1) or the male plug of another extension cord, tool, or the like (FIG. 2)—either way, allowing a twist-locking secure hold of male and female plugs as described above.

It is understood that while certain forms of this invention have been illustrated and described, it is not limited thereto except insofar as such limitations are included in the following claims and allowable functional equivalents thereof.

The invention claimed is:

1. A self-locking extension cord for extending delivery of electrical power to auxiliary extension cord having an auxiliary male electrical receptacle, comprising:

a cord member having a first end and a second end opposed to said first end, said cord member having an elongate configuration and is constructed of a metal material that defines an interior channel containing a plurality of conductive wires;

a male electrical receptacle fixedly attached to said first end of said cord member and is electrically connected to said plurality of wires in said interior channel of said cord member;

a male plug receiving member selectively and releasably coupled to said first end of said cord member, said male plug receiving member, comprising:

a first receiving portion;

a second receiving portion pivotally coupled to said first receiving portion and movable between a closed configuration in which the first and second receiving portions, together, define an interior area and an open configuration operable to receive into said interior area one of said male electrical receptacle or the auxiliary male electrical receptacle associated with the auxiliary extension cord;

a female electrical receptacle coupled to a second end of said cord member and electrically connected to the plurality of electrical wires of said cord member;

a female plug receiving member fixedly coupled to and enveloping said female electrical receptacle, said female plug receiving member including a flexible wall having a domed configuration and a female locking structure that defines a pair of receiver plug recesses, said flexible wall being constructed of a resilient material that is movable between a collapsed configuration allowing access to said pair of receiver plug recesses and a closed configuration not allowing access to said pair of receiver plug recesses;

said first receiver portion and said second receiver portion of said male plug receiving member include a receiver portion locking structure having a pair of locking tabs extending away from front edges of said first receiver portion and said second receiver portion, respectively;

said pair of receiver plug recesses are configured and operable to selectively receive said pair of locking tabs of said receiver portion locking structure, respectively;

wherein:

each locking tab includes a bent shape configuration;

each recess includes a bent shape configuration complementary to the bent shape configuration of said each locking tab, respectively, such that said first and second receiver portions, respectively, such that said first and second receiver portions are moved to a locked configuration relative to said female electrical receptacle when said pair of locking tabs are received in said pair of recesses and rotated.

2. The self-locking extension cord as in claim 1, wherein:

said bent shape configuration of said each locking tab is an L-shaped configuration; and said bent shape configuration of said each recess is an L-shaped configuration.

3. The self-locking extension cord as in claim 1, wherein:

said first receiving portion is pivotally coupled to said second receiving portion with a hinge; and said first receiving portion includes a first fastener and said second receiving portion includes a second fastener, such that said first receiving portion is coupled to said receiving portion when said first and second fasteners are engaged.

4. The self-locking extension cord as in claim 1, wherein said female electrical receptacle is configured to interface with said auxiliary male electrical plug when said auxiliary male electrical plug is removably received in said electrical cord receiving member.

5. The self-locking extension cord as in claim 1, wherein said flexible wall of said female plug receiving member has a ribbed configuration having a plurality of ribs that are spaced apart from one another at said closed configuration and adjacent to one another at said collapsed configuration.

6. The self-locking extension cord as in claim 1, wherein said cord member has an outer surface that is impermeable to water.

7. The self-locking extension cord as in claim 1, wherein:

said male plug receiving member includes a weather sealing ring operable to prevent water from entering said interior area;

said female plug receiving member includes a weather sealing ring operable to prevent water from entering said interior area.

8. A self-locking extension cord for use with an auxiliary male electrical plug, comprising:

a cord member having a first end and a second end opposed to said first end, said cord member having an elongate configuration and is constructed of a metal material that defines an interior channel containing a plurality of conductive wires;

a male electrical receptacle fixedly attached to said first end of said cord member and is electrically connected to said plurality of wires in said interior channel of said cord member;

a male plug receiving member selectively and releasably coupled to said first end of said cord member, said male plug receiving member, comprising:

a first receiving portion;

a second receiving portion pivotally coupled to said first receiving portion and movable between a closed configuration in which the first and second receiving portions, together, define an interior area and an open configuration operable to receive into said interior area one of said male electrical receptacle or the auxiliary male electrical receptacle associated with the auxiliary extension cord;

a female electrical receptacle coupled to a second end of said cord member and electrically connected to the plurality of electrical wires of said cord member;

a female plug receiving member fixedly coupled to and enveloping said female electrical receptacle, said female plug receiving member including a flexible wall having a domed configuration and a female locking structure that defines a pair of receiver plug recesses, said flexible wall being constructed of a resilient material that is movable between a collapsed configuration allowing access to said pair of receiver plug recesses and a closed configuration not allowing access to said pair of receiver plug recesses;

said first receiver portion and said second receiver portion of said male plug receiving member include a receiver portion locking structure having a pair of locking tabs extending away from front edges of said first receiver portion and said second receiver portion, respectively;

said pair of receiver plug recesses are configured and operable to selectively receive said pair of locking tabs of said receiver portion locking structure, respectively wherein:

each locking tab includes a bent shape configuration;

each recess includes a bent shape configuration complementary to the bent shape configuration of said each locking tab, respectively, such that said first and second receiver portions, respectively, such that said first and second receiver portions are moved to a locked configuration relative to said female electrical receptacle when said pair of locking tabs are received in said pair of recesses and rotated.

9. The self-locking extension cord as in claim 8, wherein:

said bent shape configuration of said each locking tab is an L-shaped configuration; and said bent shape configuration of said each recess is an L-shaped configuration.

10. The self-locking extension cord as in claim 8, wherein:

said first receiving portion is pivotally coupled to said second receiving portion with a hinge; and said first receiving portion includes a first fastener and said second receiving portion includes a second fastener, such that said first receiving portion is coupled to said receiving portion when said first and second fasteners are engaged.

11. The self-locking extension cord as in claim 8, wherein said female electrical plug is configured to interface with said auxiliary male electrical plug when said auxiliary male electrical plug is removably received in said electrical cord receiving member.

12. The self-locking extension cord as in claim 8, wherein said flexible wall of said female plug receiving member has a ribbed configuration having a plurality of ribs that are spaced apart from one another at said closed configuration and adjacent to one another at said collapsed configuration.

13. The self-locking extension cord as in claim 8, wherein said cord member has an outer surface that is impermeable to water.

14. The self-locking extension cord as in claim 8, wherein:

said male plug receiving member includes a weather sealing ring operable to prevent water from entering said interior area;

said female plug receiving member includes a weather sealing ring operable to prevent water from entering said interior area.

* * * * *